US010815698B2

(12) United States Patent
Henricks

(10) Patent No.: US 10,815,698 B2
(45) Date of Patent: Oct. 27, 2020

(54) TEMPORARY LOCKING STORAGE CONTAINER, SYSTEM AND METHOD TO REDUCE ELECTRONIC DEVICE DISTRACTION IN A GROUP SETTING

(71) Applicant: William Henricks, Glen Carbon, IL (US)

(72) Inventor: William Henricks, Glen Carbon, IL (US)

( * ) Notice: Subject to any disclaimer, the term of this patent is extended or adjusted under 35 U.S.C. 154(b) by 0 days.

(21) Appl. No.: 15/722,403

(22) Filed: Oct. 2, 2017

(65) Prior Publication Data

US 2019/0100943 A1 Apr. 4, 2019

(51) Int. Cl.

| | |
|---|---|
| ***E05B 73/00*** | (2006.01) |
| ***G07C 9/00*** | (2020.01) |
| *A45C 11/00* | (2006.01) |

(52) U.S. Cl.

CPC ..... *E05B 73/00* (2013.01); *G07C 9/00571* (2013.01); *G07C 9/00912* (2013.01); *A45C 2011/001* (2013.01); *A45C 2011/002* (2013.01); *A45C 2011/003* (2013.01); *A45F 2200/0516* (2013.01); *A45F 2200/0525* (2013.01)

(58) Field of Classification Search

CPC . E05B 73/00; G07C 9/00571; G07C 9/00912; G07C 9/00896; A45C 2011/001; A45C 2011/002; B65D 25/22; B65D 73/0014; B65D 73/005; H04B 1/0346; H04B 1/034

USPC ..... 220/3.3, 324, 694, 481, 476, 660, 602, 220/662, 480, 630; 248/313, 311.2, 248/309.1, 316.1, 689, 229.12; 361/800; 455/419, 92, 151.1, 151.2

See application file for complete search history.

(56) References Cited

U.S. PATENT DOCUMENTS

| | | | | |
|---|---|---|---|---|
| 843,191 | A * | 2/1907 | Allen | B65D 55/16 220/379 |
| 1,012,674 | A * | 12/1911 | MacDonald | B65D 25/54 220/662 |
| 5,690,604 | A * | 11/1997 | Barnett | A61H 19/44 248/229.15 |
| 5,979,750 | A * | 11/1999 | Kindell | A47G 29/141 232/1 R |
| 6,702,505 | B1 * | 3/2004 | Nutto | B62J 9/00 24/421 |
| 7,527,158 | B2 | 5/2009 | Gainer et al. | |
| 8,203,850 | B2 | 6/2012 | Bouza, II et al. | |
| 8,699,235 | B2 | 4/2014 | Soufan | |
| D738,204 | S | 9/2015 | Akana et al. | |
| 9,325,836 | B2 | 4/2016 | Cerda | |
| 9,697,663 | B2 * | 7/2017 | Johnson | A47G 29/141 |
| 9,756,552 | B1 | 9/2017 | Pickover et al. | |

(Continued)

FOREIGN PATENT DOCUMENTS

WO 2013162127 A1 10/2013

*Primary Examiner* — Robert J Hicks

(74) *Attorney, Agent, or Firm* — Armstrong Teasdale LLP

(57) ABSTRACT

A mountable container for temporary storage of an electronic device includes a cover wall opposite a base wall and an opening mechanism configured to rotate the cover wall upwards from the container. A locking mechanism is configured to secure the cover wall over the receptacle, a bracket attached to the container, and an adjustable clamp attached to the bracket that may in turn be coupled to a support structure such as a desktop or tabletop.

19 Claims, 7 Drawing Sheets

(56) References Cited

U.S. PATENT DOCUMENTS

| | | | | |
|---|---|---|---|---|
| 2006/0016953 | A1* | 1/2006 | Beck | A47B 41/06 248/460 |
| 2006/0097034 | A1* | 5/2006 | Rudduck | A47G 29/1201 232/45 |
| 2006/0217835 | A1* | 9/2006 | Stobbe | E05G 1/08 700/214 |
| 2007/0045496 | A1* | 3/2007 | Kane | A47G 23/0225 248/313 |
| 2008/0132278 | A1 | 6/2008 | Dovey | |
| 2008/0191867 | A1* | 8/2008 | Markovich | G07C 9/00912 340/539.13 |
| 2009/0056390 | A1* | 3/2009 | Falkensson | A45C 13/18 70/14 |
| 2009/0101711 | A1* | 4/2009 | Grayson | G07C 9/29 235/382.5 |
| 2010/0072206 | A1* | 3/2010 | Doyle | B65D 25/54 220/345.2 |
| 2016/0084454 | A1 | 3/2016 | Svitak, Sr. et al. | |
| 2018/0079588 | A1* | 3/2018 | Whittington | B65D 85/30 |
| 2019/0180533 | A1* | 6/2019 | Gilbertson | G07C 9/00857 |

* cited by examiner

TEMPORARY LOCKING STORAGE CONTAINER, SYSTEM AND METHOD TO REDUCE ELECTRONIC DEVICE DISTRACTION IN A GROUP SETTING

BACKGROUND OF THE INVENTION

This invention relates generally to mountable containers, and, more particularly, to a lockable container for temporarily storing an electronic device that can be mounted to a support structure.

With the integration of electronic technology in powerful mobile devices, individuals have an increasing desire to be connected with their technology wherever they happen to be. The increased number of applications accessible with handheld electronic devices has led to a proliferation of devices that are frequently used, and sometimes constantly used, for a variety of purposes. For example, people use their smart phones for not only making phone calls, but also for text messaging, sharing photos, browsing the internet, sending emails, and watching videos. Furthermore, electronic device ownership for people of all ages has greatly risen. For example, younger individuals carry electronic devices to keep in communication with friends and family, and sometimes use them for educational reasons in a school setting.

The constant access to electronic devices, and subsequently an almost infinite amount of communication and information accessible with them, can create adverse distractions that sometimes get in the way of completing important tasks. This may be especially true for younger individuals. For example, in the classroom setting, many students use their electronic devices as a distraction from learning.

BRIEF DESCRIPTION OF THE INVENTION

In one aspect, a mountable container for a desktop is provided. The mountable container includes an opening and a receptacle. The container further includes a cover wall opposite a base wall coupled to the container configured to seal the receptacle, an opening mechanism configured to rotate the cover wall upwards from the container for unsealing the receptacle, and a locking mechanism configured to secure the cover wall over the receptacle.

In another aspect, a mountable container for a desktop is provided. The mountable container includes an opening and a receptacle. The container further includes a cover wall opposite a base wall coupled to the container configured to seal the receptacle, an opening mechanism configured to rotate the cover wall upwards from the container for unsealing the receptacle, a locking mechanism configured to secure the cover wall over the receptacle, and a bracket attached to the container.

In yet another aspect, a mountable container for a desktop is provided. The mountable container includes an opening and a receptacle. The container further includes a cover wall opposite a base wall coupled to the container configured to seal the receptacle, an opening mechanism configured to rotate the cover wall upwards from the container for unsealing the receptacle, a locking mechanism configured to secure the cover wall over the receptacle, a bracket attached to the container, and an adjustable clamp attached to the bracket.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
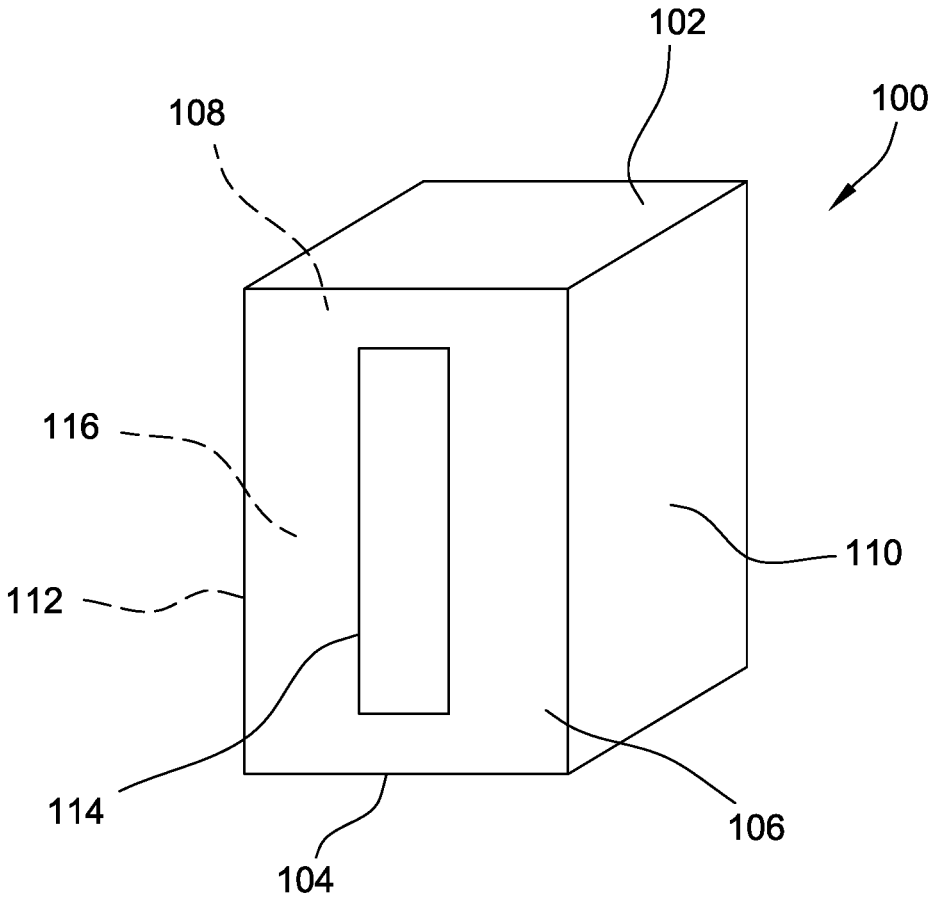
FIG. 1 is a perspective view of a container used in the tabletop mount system described herein.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

Although having constant access to information, and constant ability to communicate with other persons, is desirable in many aspects, it does create some problems in certain settings. For example, as described above, distractions in the classroom setting due to electronic device interruptions have become more prevalent due to the increased age-spread of electronic device usage. Individuals are adversely distracted when using their electronic devices in situations where their attention should be directed toward the subject matter in the classroom setting. Not only does this distract the individual actually using the electronic device, but it also distracts other individuals attempting to focus on the subject matter being taught.

Furthermore, in a live classroom setting with an instructor, the usage of electronic devices may distract the instructor as well. In a large classroom setting, it is difficult for the instructor to track, view, and correct each distraction.

A potential solution to the problems above may be to take away or ban the usage of electronic devices in the classroom setting. For many owners of the electronic devices, however, this solution may be too restrictive considering the wide acclamation of electronic device applications in everyday life. For example, in a situation where a parent desires their child to carry a mobile phone at all times in case of emergency, the banning of the device would be counterproductive.

Another potential solution may be to lock the electronic devices in a container to restrict access to the electronic device. However, not being able to view the electronic device creates problems in, for example, a situation as described above. As such, it would be desirable to provide a lockable container that is sized and dimensioned to receive an electronic device for temporary storage of an electronic device yet allowing hands-free conversation thereof, and that is also mountable a support structure or surface such as a desktop in a classroom or learning environment.

While described in the context of students in a classroom, the lockable container may serve similar purposes in other settings, such as, for example, conference room use in a business setting for adults who are prone to distracting use of electronic devices, or a movie theatre wherein restricted access to electronic devices may be desirable. As such, the lockable container is mountable to a tabletop, a chair, another piece of furniture or other support to accommodate a practically unlimited number of applications. The desktop and/or classroom environment is therefore described for the sake of illustration rather than limitation, and the benefits of the invention may accordingly accrue to other environments and mounting structures.

Exemplary embodiments of a mountable container and methods for assembly of the disclosure are described below that overcome the problems described above. The container may be sized and dimensioned to receive multiple sized electronic devices, including but not limited to, mobile phones, smart phones, tablets, and music media players. The mount included in the disclosure enables the securing of the container onto multiple sized desks, furniture, and tabletops to in different settings. Although the container includes a transparent portion to allow the user of the electronic device to view the electronic device (for example, in the case of an emergency), the container restricts the user from accessing the device using a cover for sealing and a locking mechanism.

In an exemplary embodiment, the locking mechanism may be configured to communicate with a remote control device, such that the remote control device is able to lock and unlock multiple containers within a certain distance.

In one example, the disclosure provides a mountable container for a desktop that is sized and dimensioned to receive an electronic device. The container may be made of any suitable material used for securing and protecting an electronic device, such as but not limited to, rubber, plastic, metal, and/or wood. Suitable electronic devices used in combination with the container include, but are not limited to, smart phones, mobile phones, tablets, smart watches, and/or media players.

The container defines an opening and a receptacle, such that the electronic device may be received in the receptacle of the container, and the electronic device may be viewed from the outside of the container through the opening while the container is closed and locked. As described above, the user of the electronic device is restricted from using the device while the device is locked inside the container, but is still able to view the device through the opening (for example, in the case of an emergency).

In an exemplary embodiment, the receptacle is defined by at least one outer wall, a cover wall coupled to the at least one outer wall, and a base wall coupled to the at least one outer wall and opposite the cover wall. For example (as described below in FIGS. 1-5), the container includes a first outer wall, a second outer wall coupled to and perpendicular to the first outer wall, a third outer wall coupled perpendicularly to the second outer wall and opposite the first outer wall, and a fourth outer wall coupled perpendicularly to the third outer wall and the first outer wall opposite the second outer wall. Although the container is rectangular shaped in the example embodiment, it should be known that the container may include other combinations of outer walls and container shapes suitable to receive an electronic device. For example, in some embodiments, the container may have one outer wall coupled to the cover wall and base wall. In such an embodiment, the outer wall may be a connected and continuous outer wall that gives the container a "rounded" shape. Various geometric shapes and configurations are possible.

As described above, the cover wall is located opposite the base wall and is coupled to the container. The cover wall is configured to seal the receptacle and thus the electronic device received inside the receptacle. More specifically, in the example embodiment, the cover wall is rotatable about one of its sides relative to the container. In a closed configuration, all sides of the cover wall are connected to the container restricting access to the receptacle. In an open configuration, the cover wall is rotated away from the container as described above, leaving a passageway for the container to receive an electronic device into the receptacle.

An opening mechanism is configured to rotate the cover wall upwards from the container for unsealing the receptacle. In the example embodiment, the opening mechanism is a spring-loaded mechanism coupled to the container and the cover wall. The opening mechanism may be activated in a number of ways, depending on the embodiment of the disclosure. For example, in the example embodiment, the container includes a battery that powers a switch, where the switch is connected to and communicated with the spring-loaded mechanism. The switch is further programmed to communicate with a remote device. To open the cover wall from the closed configuration, the remote device activates the switch, and the switch moves the spring loaded mechanism from a suppressed configuration into an extended configuration, thereby forcing the cover wall away (rotating away from) the container.

In some embodiments, the opening mechanism includes a lock-key mechanism for opening the container from the closed configuration. For example, the container may include a key hole that, when activated when a matching key is inserted, triggers the spring loaded mechanism to extend and force the cover wall away from the container.

In an exemplary embodiment, to close and secure the cover wall into the closed configuration, the cover wall is pushed downward towards the container, forcing the spring mechanism back into a suppressed configuration. In some embodiments, the switch mechanism may be configured to rotate the cover wall without the need for physical force (for example, a push). In this embodiment, the remote device may communicate to the switch mechanism, allowing for the switch mechanism to rotate the cover wall to the closed configuration.

As described above, the container further defines an opening that allows the electronic device to be viewed from outside the container. More specifically, an opening is located on at least one of the outer walls, the base wall, and/or the cover wall. In the example embodiment, the opening is rectangular. It should be known that the opening may be any suitable size and shape that allows for the viewing of the receptacle (and thus the electronic device inside the receptacle) from the outside of the container. The opening may be provided with a transparent element such as a clear plastic window, or may be a simple aperture or hole in the container allowing a portion of the electronic device to be viewed within the container. A user may therefore observe the device and its operation without having to remove the device from the container.

In an exemplary embodiment, the container may include a transparent wall attached to the container and covering the defined opening. The transparent wall restricts physical contact of the electronic device inside the receptacle, but is at least partly transparent to allow for viewing of the electronic device while the device remains inside. In this embodiment, the transparent wall may be made of any suitable transparent material, including but not limited to, glass and/or plastic.

In an exemplary embodiment, the container may further include a bracket attached to the container. The bracket is an overhanging member that is able to support a vertical load. The bracket includes multiple steps that allow for adjustment in the positioning of the vertical load. The bracket is attached to at least of the outer wall(s), the cover wall, and/or the base wall. In the example embodiment, the bracket is attached to the third outer wall opposite the defined opening. The steps define a plurality of grooves, and a clamp may be coupled in multiple different positions using selected ones of the grooves.

The container may likewise include an adjustable clamp attached to the bracket for securing to a portion of the desktop. The clamp may move along the steps of the bracket into different positions on the bracket. In the example embodiment, the clamp may be moved upward or downward relative to the bracket.

In an exemplary embodiment, the clamp includes a first side that attaches to the bracket. The clamp further includes a first edge and a second edge coupled to the first side. A mouth is defined between the first edge and the second edge. The mouth is sized to cover the portion of the desktop that the container is to be secured on. For example, the clamp is positioned over the edge of a desktop such that the mouth of the covers the desktop portion, the first edge of the clamp couples the top of the portion, and the second edge coupled the bottom of the portion.

In an exemplary embodiment, the clamp includes strips coupled to the first edge and the second edge and inside the mouth of the clamp. The strips allow for gripping of the first edge and the second edge onto the desktop portion in which the container is to be secured on. The strips also prevent damage to the desktop portion and the clamp from forced physical contact. In the example embodiment, the strips are made of a rubber material. In other embodiments, the strips are made of any other suitable material for securing onto the desktop portion.

In an exemplary embodiment, the clamp is adjustable such that the clamp may secure onto different sized desktop portions. For example, the first edge and the second edge may be movable about the first side of the clamp. The first edge and the second edge may be adjusted to either increase or decrease the distance between the first edge and the second edge, such that the mouth of the clamp is increased or decreased.

FIG. 1 is a perspective view of a container 100 used in, for example, a desktop or tabletop mount system. Container 100 defines an opening 114 and a receptacle 116, such that an electronic device (not shown) may be received in receptacle 116 of container 100, and may be viewed from the outside of container 100 through opening 114 (for example, by a user). As described above, the user of the electronic device is restricted from using the device while the device is inside container 100, but is still able to view the device through opening 114.

In the example embodiment, receptacle 116 is defined by at least one outer wall, a cover wall 102 opposite a base wall 104. Container 100 further includes a first outer wall 106, a second outer wall 112 coupled to and perpendicular to first outer wall 106, a third outer wall 108 coupled perpendicularly to second outer wall 112 and opposite first outer wall 106, and a fourth outer wall 110 coupled perpendicularly to third outer wall 108 and first outer wall 106 opposite second outer wall 112.

Although container 100 is rectangular shaped in FIG. 1, it should be known that container 100 may include other combinations of outer walls and container shapes suitable to receive an electronic device. For example, in some embodiments, container 100 may have one outer wall 106 coupled to cover wall 102 and base wall 104. In this embodiment, outer wall 106 is a connected and continuous outer wall 106 that gives container 100 a "rounded" shape.

As described above, cover wall 102 is located opposite base wall 104 and is coupled to container 100. Cover wall 106 is configured to seal receptacle 114 and thus the electronic device received inside receptacle 116. More specifically, in the example embodiment, cover wall 102 is rotatable about one of its sides relative to container 100. In a closed configuration (as shown in FIG. 1), all sides of cover wall 102 are connected to container 100 restricting access to receptacle 116. In an open configuration (not shown), cover wall 102 is rotated away from container 100 as described above, leaving a passageway (not shown) for container 100 to receive an electronic device into receptacle 116.

As described above, container further defines opening 114 that allows the electronic device to be viewed from outside container 100. More specifically, opening 114 is located on at least one of the outer walls 106, 112, 108, and 110, base wall 104, and/or the cover wall 102. In the example embodiment, opening 114 is rectangular shaped. It should be known that opening 114 may be any suitable size and shape that allows for the viewing of receptacle 116 (and thus the electronic device inside receptacle 116) from the outside of container 100.

In the example embodiment, container 100 includes a transparent element attached to container 100 and covering opening 114. The transparent element restricts physical contact of the electronic device inside receptacle 116, but is transparent to allow for viewing of the electronic device. In this embodiment, the transparent wall may be made of any suitable transparent material, including but not limited to, glass and/or plastic. While the illustrated embodiment includes the opening 114 and the transparent element in one of the walls, the transparent element may in some cases be considered optional and need not be included. Likewise, in a case wherein one or more of the walls of the container are fabricated from a transparent material, an opening in the wall may be considered optional and need not be included.

Figure 2:
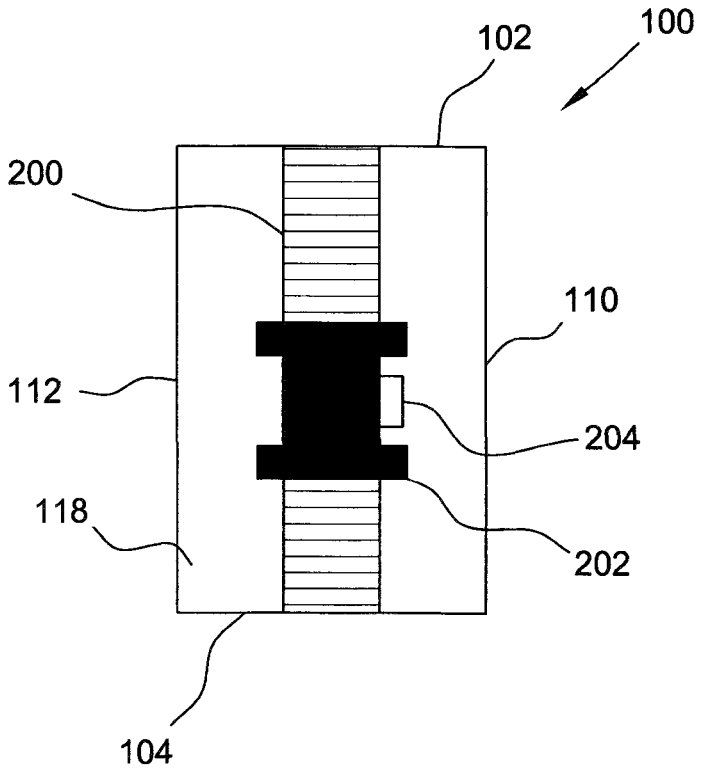
FIG. 2 is a rear view of the container shown in FIG. 1 including a bracket and a clamp.

FIG. 2 is a rear view of container 100 shown in FIG. 1 including a bracket 200 and a clamp 202. In the example embodiment, container 100 further includes bracket 200 attached to container 100. As described above, bracket 200 is an overhanging member that is able to support a vertical load. Bracket 200 includes multiple steps that allow for adjustment in the positioning of the vertical load. Bracket 200 is attached to at least of the outer wall(s), cover wall 102, and/or base wall 104. In the example embodiment, as shown in FIG. 2, bracket 200 is attached to third outer wall 118 opposite opening 114 (shown in FIG. 1). The steps define a plurality of grooves, wherein clamp 202 is moveable about bracket 200. In the example embodiment, clamp 202 includes a knob 204. Knob 204 can be turned to move clamp 202 long bracket 200 for position adjustment. As described above, clamp 202 may move along the steps of bracket 200 into different positions on bracket 200. In the example embodiment, clamp 202 may be moved upward or downward relative to bracket 100.

Figure 3:
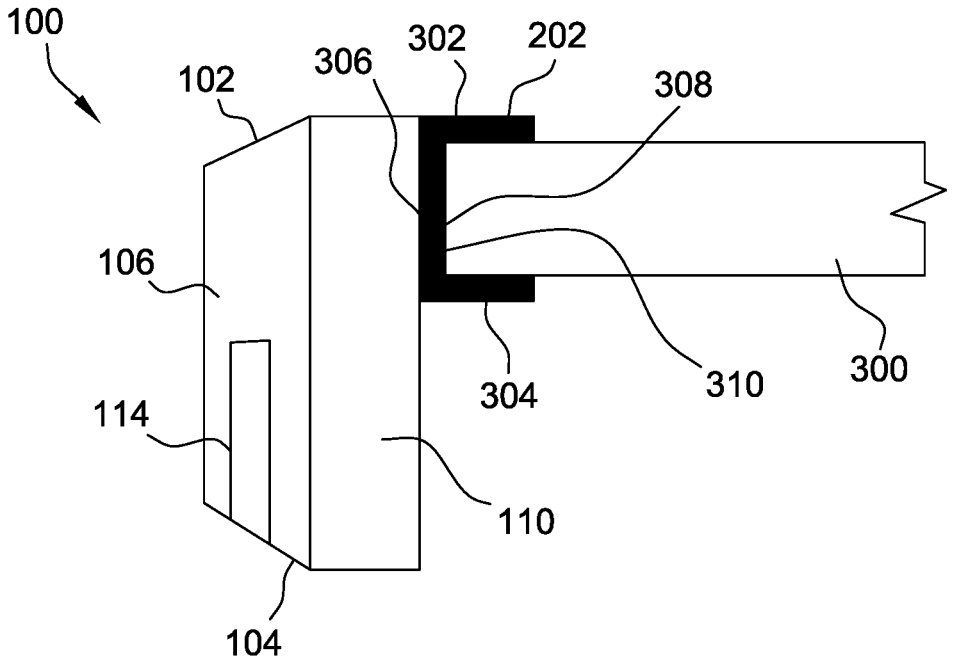
FIG. 3 is a side view on the container and clamp shown in FIGS. 1 and 2 attached to a desktop.

FIG. 3 is a side view of container 100 and clamp 202 shown in FIGS. 1 and 2. In the example embodiment, clamp 202 includes a first side 306 that attaches to bracket 200 (not shown in FIG. 3). Clamp 202 further includes a first edge 302 and a second edge 304 coupled to and extending away from first side 306. A mouth 308 is defined between first edge 302 and second edge 304.

Mouth 308 is sized to cover the portion of a desktop 300 that container 100 is to be secured on. For example, clamp 202 is positioned over the edge 310 of desktop 300 such that mouth 308 covers desktop 300, first edge 302 of clamp 202 couples the top of desktop 300, and second edge 304 couples the bottom of desktop 300.

Figure 4:
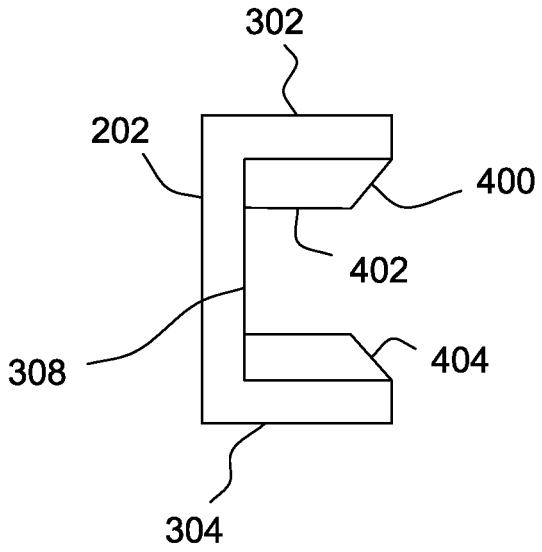
FIG. 4 is a side view of the container and clamp shown in FIGS. 1, 2, and 3 including rubber grips.

FIG. 4 is a side view of clamp 202 shown in FIGS. 2 and 3 including an end 400 including a first strip 402 and a second strip 404. First strip 402 and second strip 404 allow for gripping of first edge 302 and second edge 304 onto desktop 300 in which container 100 is to be secured on. First strip 402 and second strip 404 also prevent damage to desktop 300 and clamp 202 from forced physical contact. In the example embodiment, first strip 402 and second strip 404 are made of a rubber material. In other embodiments, first strip 402 and second strip 404 are made of any other suitable material for securing onto desktop 300.

In the example embodiment, clamp 202 is adjustable such that clamp 202 may secure onto different sized desktops or tabletops 300. For example, first edge 302 and second edge 304 may be movable about first side 306 of clamp 202. First edge 302 and second edge 304 may be adjusted to either increase or decrease the distance between first edge 302 and second edge 304, such that mouth 308 of clamp 302 is increased or decreased.

Figure 5:
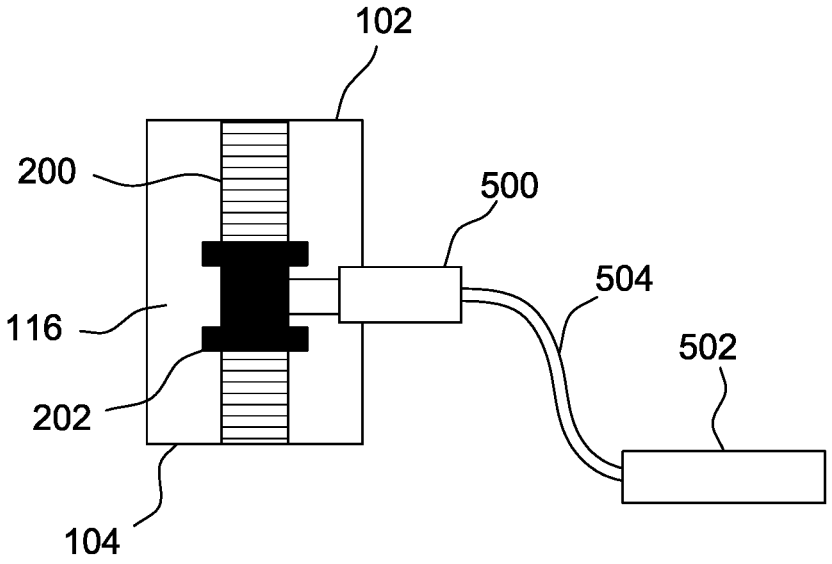
FIG. 5 is a perspective view of the container shown in FIG. 2 including a crank.

FIG. 5 is a rear view of container 100 shown in FIG. 2 including a crank 500. In some embodiments, clamp 202 may be movable about bracket 200 by using crank 500. Crank 500 includes handle 502 and arm 504. Crank 500 is detachable from clamp 202. Clamp 202 is movable about bracket 200 by attaching crank 500 to clamp 202, and rotating handle 502. It should be known that in other embodiments, any other suitable method for adjusting clamp 202 about bracket 200 may be used in place of crank 500.

Figure 6:
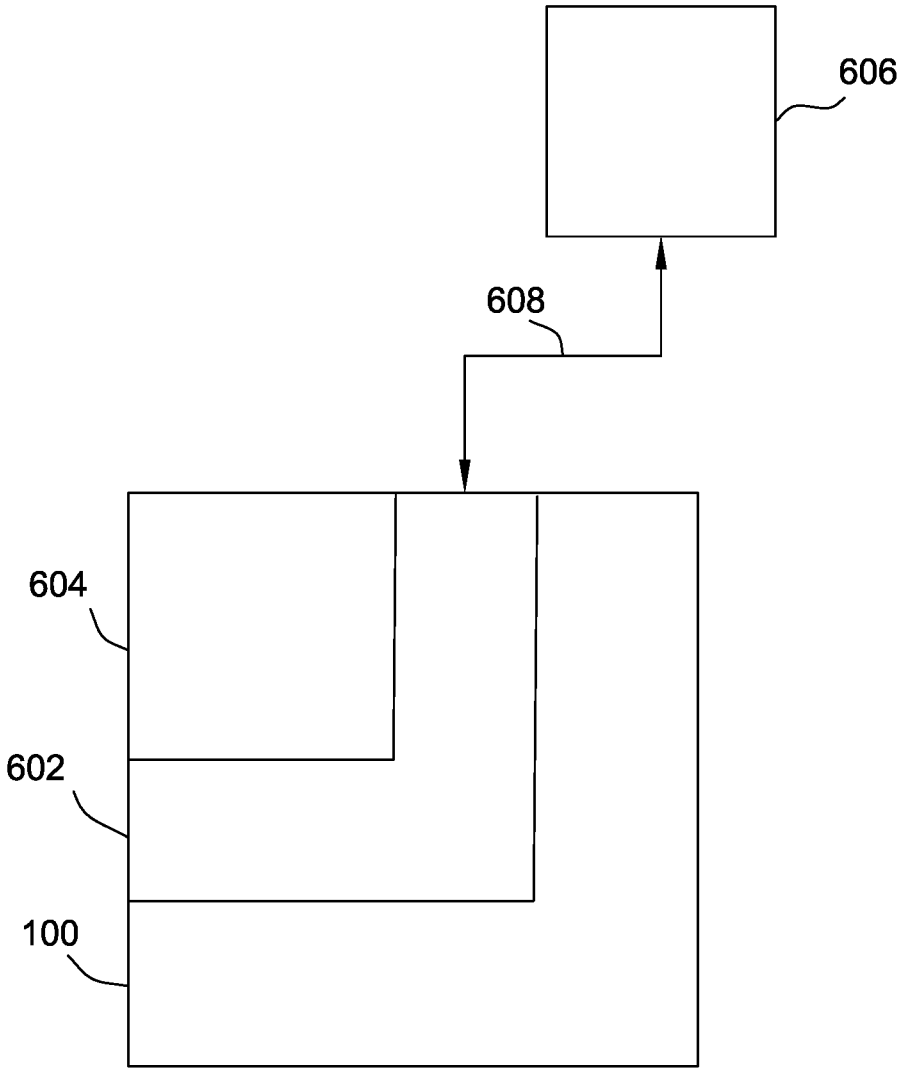
FIG. 6 is a schematic illustration of a system for locking the container shown in FIGS. 1-5.

FIG. 6 schematically illustrates a system for opening and closing the container shown in FIGS. 1-5. The system includes container 100. Container 100 includes opening mechanism 602 and locking mechanism 604. In some embodiments, opening mechanism 602 and locking mechanism 604 are one in the same. Locking mechanism 604 is configured to secure cover wall 102 over receptacle 116.

As described above, opening mechanism 602 is configured to rotate cover wall 102 upwards from container 100 for unsealing receptacle 116. In the example embodiment, opening mechanism 602 is a spring loaded mechanism coupled to container 100 and cover wall 102. Opening mechanism 602 may be activated in a number of ways, depending on the embodiment of the disclosure. For example, in the example embodiment, container 100 and opening mechanism 602 includes a battery that powers a switch, where the switch is connected to and communicated with the spring loaded mechanism. The switch is further programmed to communicate using wireless connection 608 with a remote device 606 that may be a handheld, push-button key-fob like device for use by a teacher or an instructor. To open cover wall 102 from the closed configuration, remote device 606 when actuated activates the switch, and the switch moves the spring loaded mechanism from a suppressed configuration into an extended configuration, thereby forcing cover wall 102 away (rotating away from) container 100.

In the example embodiment, to close and secure cover wall 102 into the closed configuration, cover wall 102 is pushed downward towards container 100, forcing the spring mechanism back into a suppressed configuration. In some embodiments, the switch may be configured to rotate cover wall 102 without the need for physical force (for example, a push). In this embodiment, the remote device may communicate to the switch, allowing for the switch to rotate cover wall 102 to the closed configuration.

Figure 7:
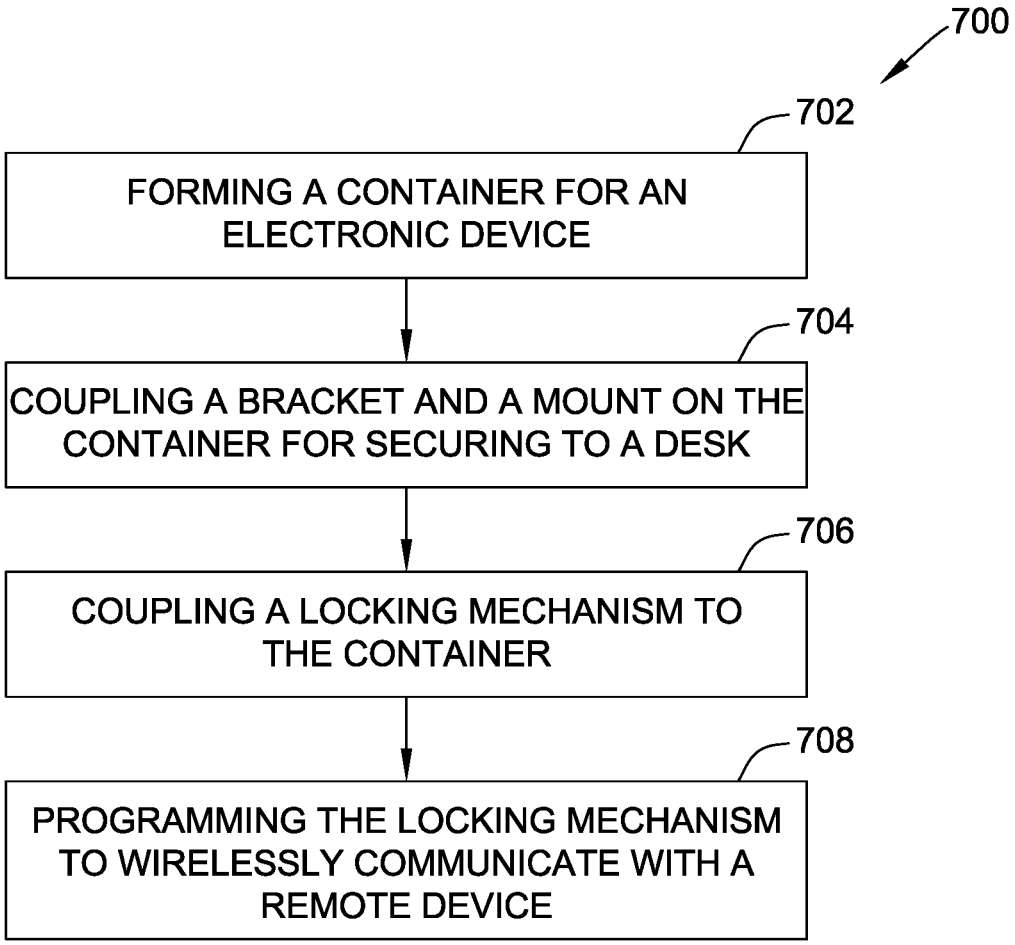
FIG. 7 is a flow diagram of a method for making the mountable container shown in FIGS. 1-5.

FIG. 7 is a flow diagram of a method 700 for making the mountable container shown in FIGS. 1-5. Method 700 includes forming 702 the container as described above. The container may be made of any suitable material used for securing and protecting an electronic device, such as but not limited to, rubber, plastic, metal, and/or wood. Suitable electronic devices used in combination with the container include, but are not limited to, smart phones, mobile phones, tablets, smart watches, and/or media players.

As described above, the container defines an opening and a receptacle, such that the electronic device may be received in the receptacle of the container, and may be viewed from the outside of the container through the opening. As described above, the user of the electronic device is restricted from using the device while the device is inside the container, but is still able to view the device through the opening (for example, in the case of an emergency).

The method further includes coupling 704 a bracket and a clamp to the container for securing to a desktop. As described above, the bracket is an overhanging member that is able to support a vertical load. The bracket includes multiple steps that allow for adjustment in the positioning of the vertical load. The bracket is attached to at least of the outer wall(s), the cover wall, and/or the base wall. In the example embodiment, the bracket is attached to the third outer wall opposite the defined opening. The steps define a plurality of grooves, wherein the clamp is moveable about the bracket.

The adjustable clamp is attached to the bracket for securing to a portion of the desktop. The clamp may move along the steps of the bracket into different positions on the bracket. In the example embodiment, the clamp may be moved upward or downward relative to the bracket.

Method 700 further includes coupling 706 at least one of an opening mechanism and or a locking mechanism to the container. The opening mechanism is configured to rotate the cover wall upwards from the container for unsealing the receptacle. In the example embodiment, the opening mechanism is a spring loaded mechanism coupled to the container and the cover wall.

The opening mechanism may be activated in a number of ways, depending on the embodiment of the disclosure. For example, in the example embodiment, the container includes a battery that powers a switch, where the switch is connected to and communicated with the spring loaded mechanism.

Method 700 further includes programming 708 at least one of the opening mechanism and/or locking mechanism to wirelessly communicate with a remote device. The switch is further programmed to communicate with a remote device. To open the cover wall from the closed configuration, the remote device activates the switch, and the switch moves the spring loaded mechanism from a suppressed configuration into an extended configuration, thereby forcing the cover wall away (rotating away from) the container. Programming of any processor-based elements included in the container and/or the remote device 606 is within the purview of those in the art and is not further explained herein.

Exemplary embodiments of a mountable container that includes a bracket and a clamp configured to secure to a desktop have been described above in detail. The container is not limited to the specific embodiments described herein, but rather, components of the container and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

In contemplated embodiments, multiple containers are provided that may be attached to a tabletop adjacent each seat to be occupied by a student, or to each desk provided for use by a student. Once the container is mounted to the desktop or tabletop, a student may deposit his or her electronic device (e.g., a smartphone) into the container mounted adjacent his or her seat or mounted to his or her desk. While the containers described are configured to receive a single electronic device, in some cases the container may be configured to receive more than one electronic device such that students seated adjacent one another may each use a portion of the same container.

When class begins, the containers are locked are either individually or collectively via remote actuation, and during the class the students may observe their devices in the container and therefore may see, for example, if they have received a text message, but cannot access the device to respond to until the container is unlocked (typically at the end of the class or the end of the teaching portion of the class). As appropriate, however, the teacher may individually or collectively unlock the containers as needed so that, in the case of an emergency message to a student, the student may be allowed to respond. The device is therefore available if truly needed, but presents minimal distraction if not truly needed. The student may wait to respond or use the device until a subsequent time when the container is unlocked.

Numerous variations and adaptations are further possible. For example, in some cases, the containers may operate with respect to timers and thus automatically lock and unlock at designated times that can be synchronized with a school schedule, with capability to interrupt as needed and allow access to selected electronic devices in emergency situations (or other situations deemed appropriate by a teacher or instructor). Likewise, the containers may be manually locked and manually unlocked as desired without necessarily using a remote device. Finally, the same container may be operable in combinations of these modes (e.g., remotely unlockable, unlockable at an expiration of a timer or at a pre-selected time, and manually operable) such that the same teacher or instructor may use the device in different ways to meet the needs of different classes and different groups of students.

While the invention has been described in terms of various specific embodiments, those skilled in the art will recognize that the invention can be practiced with modification within the spirit and scope of the claims.

What is claimed is:

1. A temporary storage container assembly restricting access to an operating portable electronic device in a group setting including at least one person possessing the portable electronic device and prone to distracting use of the operating portable electronic device while an instructor is teaching the group, the temporary storage container assembly comprising:

a container body fixably located in view of the at least one person, the container body including a plurality of side walls defining a receptacle, the receptacle being sized and dimensioned to contain the operating portable electronic device when deposited in the receptacle by the at least one person prone to distracting use;

a cover being rotatably attached to one of the plurality of side walls of the container body, wherein the cover is rotatable away from the container body to an open position establishing a passageway to receive the operating portable electronic device, and wherein the cover is rotatable toward the container body to a closed position restricting physical access to the operating portable electronic device in the receptacle;

wherein the container body or the cover is at least partly transparent and allows the at least one person prone to distracting use to observe an operational state of the portable electronic device while the cover is locked in the closed position and while the instructor is teaching the group;

a locking mechanism maintaining the cover in the closed position while the instructor is teaching the group; and a switch coupled to the container body and in direct communication with a remote control device located in the group setting at a distance from the container body and including at least one push-button that is manually operable on demand by the instructor in the group setting to authorize a removal of the operating portable electronic device from the container body, the switch being responsive to an actuation of the at least one push-button in the group setting to automatically unlock the locking mechanism and therefore allow the operating portable electronic device to be retrieved and repossessed for use by the at least one person prone to distracting use.

2. The temporary storage container assembly in accordance with claim 1, further comprising an opening mechanism configured to rotate the cover away from the container body when the locking mechanism is unlocked.

3. The temporary storage container assembly in accordance with claim 1, wherein the switch is battery powered.

4. The temporary storage container assembly in accordance with claim 1, wherein the switch is in wireless communication with the remote control device.

5. The temporary storage container assembly in accordance with claim 1, wherein the remote control device is a handheld, push-button key-fob device.

6. The temporary storage container assembly in accordance with claim 1, wherein the operating portable electronic device is selected from the group consisting of a mobile phone, a smartphone, a tablet, a smart watch, and a music media player.

7. The temporary storage container assembly of claim 1, wherein the receptacle is sized and dimensioned to receive more than one operating portable electronic device.

8. The temporary storage container assembly of claim 1, further comprising a mounting bracket attachable to the container body.

9. The temporary storage container assembly of claim 8, wherein the container body is fixably located to one of a desktop or a tabletop in the group setting.

10. A system for restricting access to a plurality of operating portable electronic devices in a group setting including a plurality of persons prone to distracting use of respective operating portable electronic devices possessed by each of the plurality of persons in the group setting while an instructor is teaching, the system comprising:

a plurality of temporary storage container assemblies fixedly located in the group setting, each of the plurality of temporary storage container assemblies comprising:

a container body defining a receptacle, the receptacle being sized and dimensioned to contain one or more operating portable electronic devices possessed by one of the persons in the group setting;

a cover being rotatably attached to the container body, wherein the cover is rotatable away from the container body to an open position establishing a passageway to receive the at one or more operating portable electronic devices when deposited therein by the person possessing the one or more operating portable electronic devices, and wherein the cover is rotatable toward the container body to a closed position restricting physical access to the at least one operating portable electronic device in the receptacle;

wherein the container body or the cover is configured to allow observation of the operating portable electronic device when the cover is in the closed position;

a locking mechanism maintaining the cover in the closed position while the instructor is teaching the persons in the group setting; and a switch coupled to the container body; and a single remote control device located in the group setting and in direct communication with each switch of the plurality of temporary storage container assemblies, the single remote control device including a push-button operable on demand by the instructor to collectively and automatically unlock the respective locking mechanisms in the plurality of temporary storage container assemblies to permit physical access to the respective operating portable electronic devices by each of the plurality of persons.

11. A system in accordance with claim 10 wherein the container body or the cover in each of the plurality of temporary storage container assemblies is at least partly transparent to allow observation of an operating state of the one or more operating portable electronic devices while the cover is locked in the closed position.

12. A system in accordance with claim 11, wherein each of the plurality of temporary storage container assemblies further comprises an opening mechanism configured to rotate the cover wall away from the container body when the locking mechanism is unlocked.

13. A system in accordance with claim 12, wherein the switch of each of the plurality of temporary storage container assemblies is battery powered.

14. A system in accordance with claim 13, wherein the single remote control device wirelessly communicates with the switch of each of the plurality of temporary storage container assemblies.

15. A system in accordance with claim 10, wherein the operating portable electronic device is selected from the group consisting of a mobile phone, a smartphone, a tablet, a smart watch, and a music media player.

16. A system in accordance with claim 10, further comprising a mounting bracket configured to secure the container body to a support structure in the group setting.

17. A system in accordance with claim 10, wherein the plurality of container bodies are fixably secured to desktops or a tabletop in the group setting.

18. A method for restricting access to operating portable electronic devices in a group setting including persons prone to distracting use of the operating portable electronic devices in the group setting while an instructor is teaching, the operating portable electronic devices being selected from the group consisting of a mobile phone, a smartphone, a tablet, a smart watch, and a music media player;

wherein the method is implemented with a system including:

a plurality of temporary storage container assemblies fixedly located in the group setting, each of the plurality of temporary storage container assemblies comprising:

a container body defining a receptacle sized and dimensioned to contain an operating portable electronic device;

a cover being rotatably attached to the container body, wherein the cover is rotatable away from the container body to an open position establishing a passageway to receive the operating portable electronic device, and wherein the cover is rotatable toward the container body to a closed position restricting physical access to the operating portable electronic device in the receptacle;

wherein the container or the cover is configured to allow observation of the operating portable electronic device when the cover is in the closed position;

a locking mechanism maintaining the cover in the closed position, and a switch coupled to the container body; and a single remote control device in the group setting and in direct communication with each switch of each of the plurality of temporary storage container assemblies, the single remote control device including a push-button operable to cause the switches to collectively and automatically unlock all of the locking mechanisms in the plurality of temporary storage container assemblies;

wherein the method comprises:

locking the plurality of temporary storage container assemblies after each person possessing an operating portable electronic device deposits the operating portable electronic device into respective ones of the plurality of temporary storage container assemblies; and collectively and automatically operating all of the switches in the plurality of the temporary storage container assemblies and therefor unlocking all of the locking mechanisms of all of the plurality of the temporary storage container assemblies, on demand and in response to manual operation of the push-button of the single remote control device by the instructor, thereby allowing the respective persons access to their respective portable electronic devices for retrieval and use.

19. The method of claim 18, wherein collectively unlocking comprises wirelessly and collectively communicating, via the single remote control device with all of the switches in each of the plurality of temporary storage container assemblies.

* * * * *